US005388428A

United States Patent [19]

Harper

[11] Patent Number: 5,388,428

[45] Date of Patent: Feb. 14, 1995

[54] GAS EXPANSION REFRIGERATION SYSTEM

[76] Inventor: Murry D. Harper, 218 22nd St., Dunbar, W. Va. 25064

[21] Appl. No.: 79,928

[22] Filed: Jun. 23, 1993

[51] Int. Cl.[6] ..... F25D 9/00

[52] U.S. Cl. ..... 62/402; 418/61.2

[58] Field of Search ..... 62/402; 418/61.5

[56] References Cited

U.S. PATENT DOCUMENTS

| | | | |
|---|---|---|---|
| 1,673,153 | 6/1928 | MacLaren | 62/402 |
| 1,726,462 | 8/1929 | Wittig . | |
| 2,045,152 | 6/1936 | Lebre | 62/170 |
| 2,046,314 | 7/1936 | Benkly | 62/402 |
| 2,708,834 | 5/1955 | Dodge | 62/136 |
| 2,988,065 | 6/1961 | Wankel et al. | 123/8 |
| 3,465,646 | 9/1969 | Kiester et al. | 91/121 |
| 3,686,893 | 8/1972 | Edwards | 62/402 |
| 4,170,116 | 10/1979 | Williams | 62/402 |
| 4,297,090 | 10/1981 | Hoffmann | 418/61.2 |
| 4,389,299 | 6/1983 | Griffith | 418/61.2 |
| 4,410,172 | 10/1983 | Shimoyama | 418/61.2 |
| 4,730,464 | 3/1988 | Lotz | 62/401 |

*Primary Examiner*—Ronald C. Capossela

*Attorney, Agent, or Firm*—Jacobson, Price, Holman & Stern

[57] ABSTRACT

A refrigeration system in which a compressed gas such as air is utilized in a rotary motor which enables the gas to expand for extracting heat by combining with or coming into contact with ambient atmosphere, air in an enclosure or articles, products or devices to be reduced in temperature. The rotary motor or expansion device is constructed in accordance with the well known structure of a Wankel engine except that the rotor of the motor is driven in relation to a stationary housing or casing by the introduction of compressed gas or air. The usually provided carburetor structure, intake manifold and ignition system are removed or modified with an inlet passage and exhaust passage being retained with the inlet passage being connected to a source of compressed air or gas through a control system and the outlet passage being communicated with atmosphere thus reducing the temperature of the expanded air or gas with the temperature reduction being up to 80° F. to 90° F. depending upon the operating conditions. The rotary motor is provided with an output shaft having a propeller mounted thereon to effectively control the speed of the motor for operation at highest efficiency.

3 Claims, 2 Drawing Sheets

GAS EXPANSION REFRIGERATION SYSTEM

BACKGROUND OF THE INVENTION

1. Field of the Invention

The present invention generally relates to a refrigeration system and more specifically a refrigeration unit in which a compressed gas such as air is utilized in a rotary motor which enables the gas to expand for extracting heat by combining with or coming into contact with ambient atmosphere, air in an enclosure or articles, products or devices to be reduced in temperature. The rotary motor or expansion device is constructed in accordance with the well known structure of a Wankel engine except that the rotor of the motor is driven in relation to a stationary housing or casing by the introduction of compressed gas or air in which the usually provided carburetor structure, intake manifold and ignition system are removed with an inlet passage and exhaust passage being retained to enable the inlet passage to be connected to a source of compressed air or gas through a control system and the exhaust passage to communicate with atmosphere. The temperature of the compressed air or gas is reduced, when expanded, up to 80° F. to 90° F. depending upon the operating conditions and structure. The rotary motor is provided with an output shaft having a propeller mounted thereon to effectively control the speed of the motor for operation at highest efficiency.

2. Description of the Prior Art

It is well known that gas or air absorbs energy and thus elevates in temperature when being compressed and releases such energy and thus being cooled when expanded. Various compressed gas or air driven motors are well known for utilizing compressed gas or air as an energy source. Relevant devices are disclosed in the following U.S. Pat. Nos.

1,726,462
2,045,152
2,708,834
3,465,646
3,686,893
4,730,464

While various refrigeration systems are known utilizing the compression/expansion cycle of a refrigerant, the prior art does not include a compressed gas or air motor having a housing or casing, and a triangular rotor constructed in accordance with the structure of a Wankel engine utilizing a compressed gas or air inlet and an expanded, increased velocity gas or air outlet combined with a propeller mounted on an output shaft connected with the rotor in which the expanded gas or air is utilized to cool surrounding atmospheric air, an enclosure, articles or products in which the expanded cooled air or gas combines with or comes into contact with material or surfaces to be cooled.

SUMMARY OF THE INVENTION

An object of the present invention is to provide a gas or air refrigeration system or unit incorporating a rotary motor, similar to a Wankel engine, which is used as an expansion device to enable compressed gas or air to expand while driving a rotor in relation to a stationary housing or casing and then being discharged at a higher velocity and at a reduced temperature for providing a refrigerating effect to air, surfaces, articles, products or any other item to be cooled which is contacted by or combined with the discharged, expanded, increased velocity, cooled gas or air.

Another object of the invention is to provide a refrigeration device in accordance with the preceding object in which the rotor of the rotary motor includes a support shaft which extends outwardly of the housing or casing as a power shaft having a propeller mounted thereon which rotates in ambient air and provides a control for the rotational speed of the rotor thereby controlling operation of the refrigeration device by controlling the rotational speed and thus the expansion rate of the compressed gas or air.

Another object of the invention is to provide a refrigeration device in accordance with the preceding objects which is quite simple in operation, effective for reducing the temperature of the expanded gas or air up to but not necessarily limited to a reduction of approximately 80° to 90° F. reduction and which can be used to extract heat from various gases, air, surfaces, products and the like.

These together with other objects and advantages which will become subsequently apparent reside in the details of constructions and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
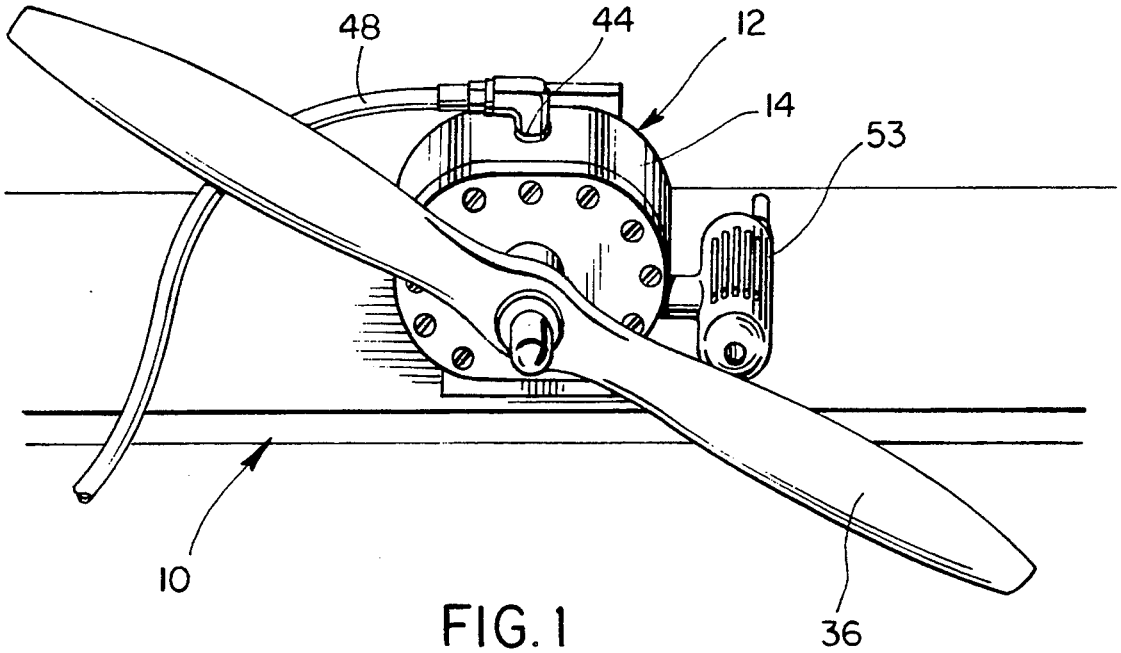
FIG. 1 is a perspective view of a refrigeration system or unit constructed in accordance with the present invention.

Referring now specifically to the drawings, the refrigeration system of the present invention is generally designated by reference numeral 10 and includes a rotary motor generally designated by reference numeral 12 which is in the form of a modified or altered Wankel engine driven by the inlet of a compressed gas or air rather than a fuel and air mixture which is provided by a carburetor which is ignited by an ignition device as in a conventional Wankel internal combustion engine such as shown in U.S. Pat. No. 2,988,065 issued Jun. 13, 1961.

Figure 2:
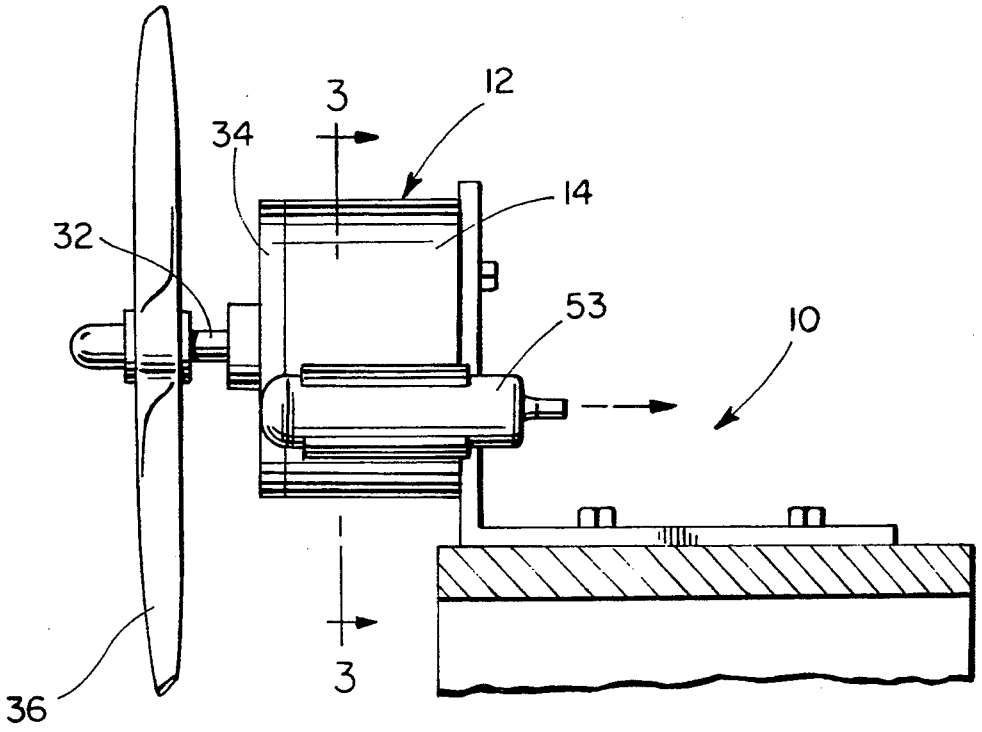
FIG. 2 is a side elevational view thereof.
Figure 3:
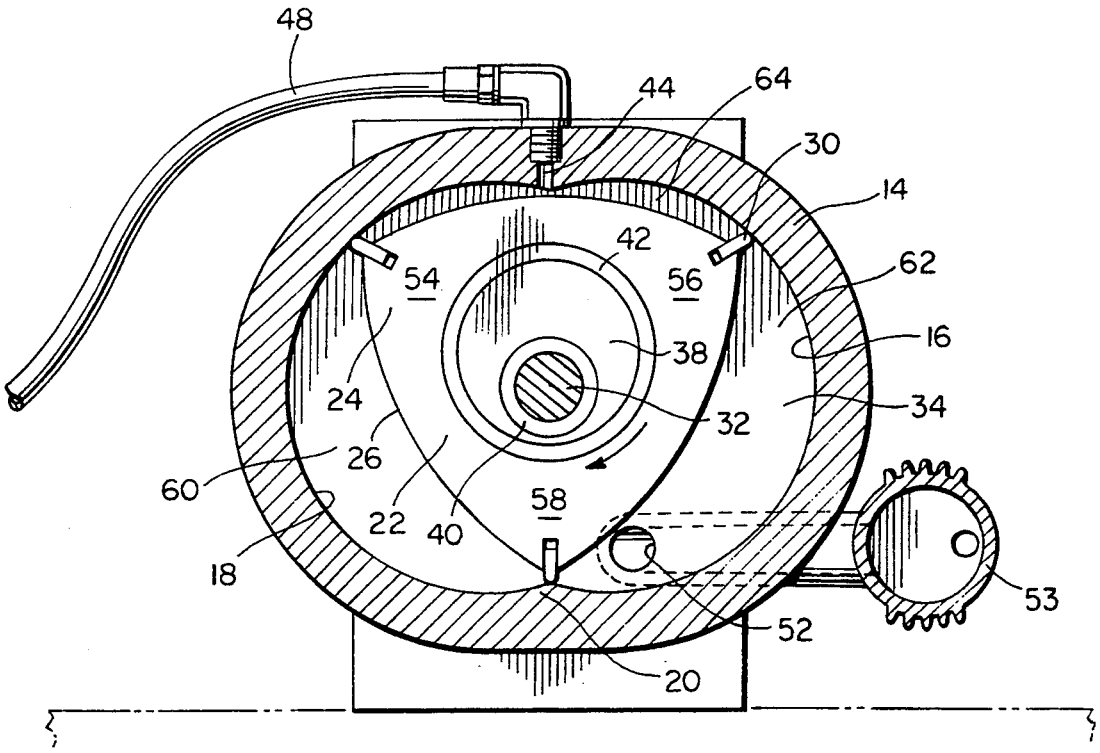
FIG. 3 is a transverse, sectional view illustrating the relation of the components in one position of the rotor and the clockwise direction of rotation of the rotor.

The motor 12 includes a stationary housing or casing 14 of cycloid shape which includes a pair of partial cylindrical surfaces 16 and 18 forming the interior thereof with the surfaces 16 and 18 being joined at diametrically opposed points or juncture areas 20 which project into the hollow interior of the casing as illustrated in FIGS. 2 and 3. Positioned internally of the casing 14 is a rotor 22 which generally is of triangular configuration with the three lobes 24 including continuous convexly curved surfaces 26 between the apices 28 at the corners of the triangular lobe 22. Each apex 28 of the rotor 22 is provided with a radially moveable seal rib 30 in contact with the interior surface of the casing 14 in a manner which is the same as in a Wankel engine.

The rotor 22 is supported by a main shaft 32 which is journaled in bearing structures in the end walls 34 of the casing 14 with one end of the shaft 32 supporting a propeller 36 which rotates in the ambient surrounding air. Supported on the main shaft 32 is an eccentric member 38 of generally cylindrical configuration with the main shaft 32 being eccentric in relation to the eccentric member 38 with a bearing structure 40 interposed therebetween. The eccentric member 38 is mounted centrally in the rotor 22 with a bearing structure 42 interposed between the eccentric member 38 and the rotor 22 in a manner similar to a Wankel engine.

An air inlet or passageway 44 is provided in the casing 14 adjacent a central portion thereof and closely adjacent the projection 20 where the two partial cylindrical surfaces merge with the inlet 44 being on the approach side of one of the seal ribs 30 and one of the lobes 24 as they approach the projection 20 as illustrated in FIG. 3. The inlet 44 is communicated with a source of compressed air or gas which may be in the form of storage tank or the like communicated with a compressor of any suitable type to provide an adequate volume of compressed air at a pressure of approximately 100 lbs. per sq. inch with a tube 48 connected with the inlet 44 with a control valve in the tube for controlling inlet of compressed air or gas into the housing 14.

The end wall 34 opposite to the propeller 36 is provided with an outlet 52 in the form of a discharge passageway which exhausts expanded and cooled air or gas from the casing 14 into an exhaust manifold and muffler arrangement 53 from which the higher velocity, increased volume and cooled gas or air is discharged for mixing with ambient air, contacting surfaces, articles, products or the like to be cooled.

Figure 4:
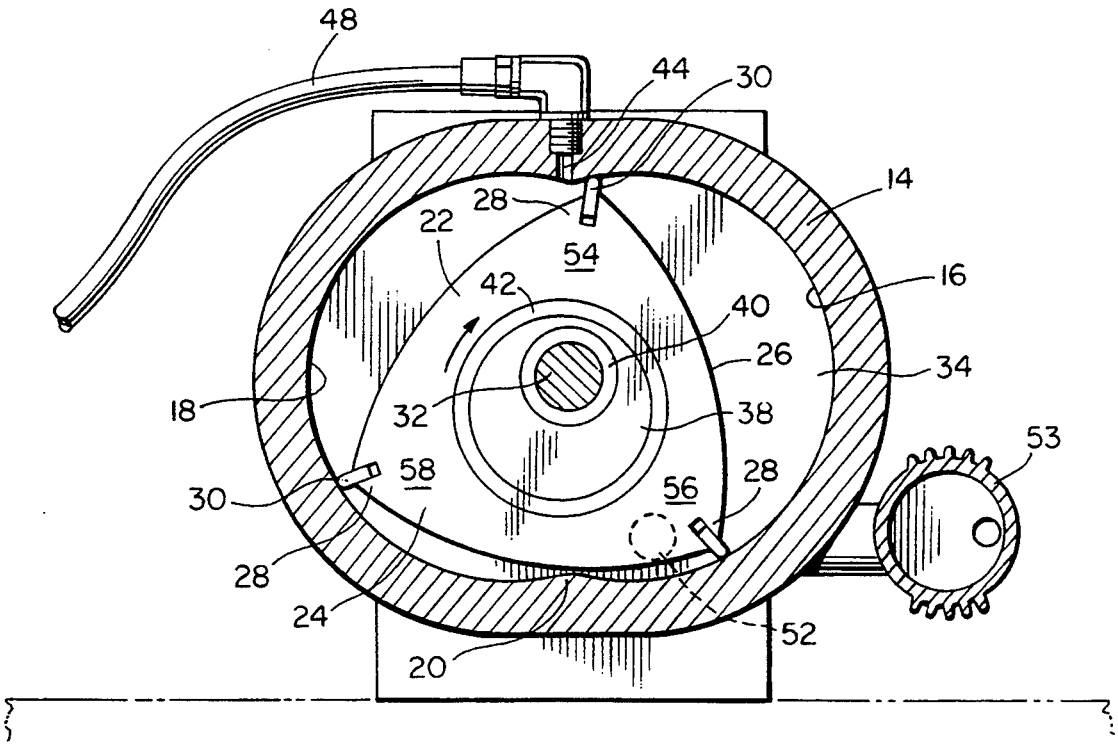
FIG. 4 is a sectional view similar to FIG. 3 but illustrating the orientation of the rotor when compressed air is admitted at two degrees after top dead center.

As illustrated in FIGS. 3 and 4, the three lobes 24 are specifically designated by reference numerals 54, 56 and 58 with the area between lobes 58 and 54 as illustrated in FIG. 2 being a vacuum or low pressure area 60 between the ribs 30 on the lobe 58 and 54 in FIG. 3. The area between the seal rib 30 on the lobe 56 and the seal ring 30 on the lobe 58 is an expansion/exhaust area 62. The area between the seal rib 30 on the lobe 56 and the projection 30 at the inlet 14 is a high pressure expansion area 64 which receives the compressed air or gas and expands and produces rotational torque on the rotor 22 as the lobe 56 and the seal rib thereon moves toward the exhaust port 52 in a clockwise direction with this expansion continuing until the rib 30 on the lobe 56 passes the discharge port 52 and cooperates with the projection 20 to provide the low pressure or vacuum area 60 in FIG. 4. The operation of the rotor in relation to the casing is substantially the same as a Wankel engine during its intake, expansion or power and exhaust cycle.

In a bench test of the present invention, a small Wankel engine, conventionally used as a model aircraft engine, as illustrated in FIGS. 1 and 2, was modified by removing the existing carburetor and blocking off the intake manifold and providing a source of compressed air connected to the inlet 44 by a tube 48 having a valve therein. The source of compressed air was at 100 psi and the rotational direction of the rotor 22 is clockwise.

With approximately two to three cubic feet per minute of compressed air entering the air inlet, ambient air temperature of approximately 70° F. dropped approximately 80° F. to −10° F. discharged from the outlet or discharge 52. The output of the main shaft 32 having the propeller 36 connected thereto was approximately ½ horsepower. The rotational speed of the shaft 32 was approximately 3 to 1 over the rotational speed of the rotor 22. The temperature drop occurred after approximately 20 seconds of operation. However, as indicated above, the temperature drop, the volume of compressed air or gas passing through the rotary motor and other factors will vary the output of the device to enable it to be constructed by using various sizes of existing Wankel engines in which the carburetor is removed along with ignition devices that would normally ignite a combustible mixture of fuel and air supplied to the Wankel engine. The discharge from the refrigeration system may be passed through a tube having high heat conductive characteristics to enable cooling of various enclosed spaces or cooling contact with various surfaces, articles, products and the like with the discharge tubing being capable of being formed in a coil or the system may utilize tandemly arranged expansion devices to reduce the discharge temperature to even a lower temperature. The propeller serves to control the rotational speed of the rotor and thus the capacity of the refrigeration unit with the propeller also causing an air flow over the refrigeration system at a velocity of approximately 220 miles per hour. Depending upon the requirements of each use, the casing may be provided with insulation material on or surrounding the casing. In the event of high humidity conditions, freezing of moisture may occur in association with the outlet or discharge port, muffler or cooling coil depending upon the operating temperatures and conditions of ambient air.

The foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed as new is as follows:

1. A refrigeration system comprising a source of compressed air, said compressed air being at ambient temperature and compressed to approximately 100 psi., an expansion motor having an inlet communicated with the source of compressed air and an outlet communicated with the expansion motor for discharging expanded air at a temperature substantially below the ambient temperature of the compressed air for cooling ambient air, surfaces, articles, products and the like, said expansion motor comprising a stationary casing with a hollow interior, a rotor journaled in said casing, a main shaft supporting said rotor in the casing and extending outwardly of the casing, a propeller on said main shaft outwardly of the casing, said casing including said inlet and said outlet, said rotor including sealing ribs engaged with the casing to provide intake, expansion and discharge cycles as the compressed air is expanded and discharged at a lower temperature for cooling purposes, said propeller being positioned externally of the casing in ambient air and utilizing energy when rotated thereby controlling rotational speed of the rotor thereby controlling the rate of increase in volume, reduction in pressure to approximately atmospheric pressure and reduction in temperature to substantially below ambient temperature.

2. The refrigeration system as defined in claim 1 wherein said casing is cycloid in shape with two connected partial cylindrical internal hollow areas, said rotor being of generally triangular configuration with a sealing rib at each apex thereof, said rotor being supported from said shaft by an eccentric member to move the rotor eccentrically in relation to the casing during rotation of the output shaft.

3. The refrigeration system as defined in claim 1 wherein the temperature of the discharged expanded air is about 80° F. less than ambient temperature, said outlet including a lateral manifold and muffler disposed in laterally spaced relation to said casing in generally parallel relation to the main shaft, said muffler having a closed end adjacent the propeller and a discharge in remote relation to said propeller.

* * * * *